US009080408B2

(12) United States Patent
Møgedal

(10) Patent No.: US 9,080,408 B2
(45) Date of Patent: Jul. 14, 2015

(54) BOP LOCK DOWN

(75) Inventor: Knut Møgedal, Asker (NO)

(73) Assignee: Aker Subsea AS, Lysaker (NO)

( * ) Notice: Subject to any disclaimer, the term of this patent is extended or adjusted under 35 U.S.C. 154(b) by 0 days.

(21) Appl. No.: 13/885,481

(22) PCT Filed: Nov. 10, 2011

(86) PCT No.: PCT/EP2011/069800

§ 371 (c)(1),
(2), (4) Date: May 15, 2013

(87) PCT Pub. No.: WO2012/065896

PCT Pub. Date: May 24, 2012

(65) Prior Publication Data

US 2013/0240216 A1 Sep. 19, 2013

(30) Foreign Application Priority Data

Nov. 16, 2010 (NO) ..... 20101610

(51) Int. Cl.

| | |
|---|---|
| ***E21B 33/038*** | (2006.01) |
| ***E21B 41/08*** | (2006.01) |
| ***E21B 19/00*** | (2006.01) |
| ***E21B 33/043*** | (2006.01) |
| ***E21B 41/00*** | (2006.01) |

(52) U.S. Cl.

CPC ..... *E21B 33/038* (2013.01); *E21B 19/002* (2013.01); *E21B 33/043* (2013.01); *E21B 41/0007* (2013.01); *E21B 41/08* (2013.01)

(58) Field of Classification Search

CPC .... E21B 33/038; E21B 41/0007; E21B 41/08

USPC ..... 166/368, 338, 351, 360, 85.4, 79.1, 166/96.1

See application file for complete search history.

(56) References Cited

U.S. PATENT DOCUMENTS

| | | | | |
|---|---|---|---|---|
| 1,543,637 | A * | 6/1925 | Woll | 166/93.1 |
| 1,905,592 | A * | 4/1933 | Knowlton et al. | 166/73 |
| 1,913,041 | A * | 6/1933 | Gwynne | 166/91.1 |
| 1,935,027 | A * | 11/1933 | Heggem | 166/89.1 |
| 1,942,597 | A * | 1/1934 | Hewgley | 166/96.1 |
| 2,174,001 | A * | 9/1939 | Howard | 166/96.1 |

(Continued)

FOREIGN PATENT DOCUMENTS

| | | | |
|---|---|---|---|
| EP | 0952300 | A1 | 10/1999 |
| WO | WO-03/004830 | A1 | 1/2003 |

(Continued)

OTHER PUBLICATIONS

Hustedt, Bernhard, "International Search Report" for PCT/EP2011/069800, as mailed Jul. 17, 2012, 4 pages.

*Primary Examiner* — Matthew Buck
(74) *Attorney, Agent, or Firm* — Winstead PC

(57) ABSTRACT

A well head system for application in sub sea well exploration comprising a well head (23) having a well head housing secured to a well casing, at least one valve stack, e.g. a BOP (1) located atop said well head (23). The valve stack is removably locked on a well template (15) supporting said well head by a plurality of locking devices (7). Also described is a locking device comprising two opposite clamping arms (19) hingedly attached to a main frame (21). The Main frame is slidable relative to a spindle (17) and can be selectively secured to the spindle (17).

10 Claims, 8 Drawing Sheets

(56) References Cited

U.S. PATENT DOCUMENTS

| | | | | | |
|---|---|---|---|---|---|
| 3,603,385 | A | | 9/1971 | Jones | |
| 4,212,562 | A | * | 7/1980 | Stone et al. | 405/195.1 |
| 4,438,817 | A | * | 3/1984 | Pokladnik et al. | 166/341 |
| 4,461,354 | A | * | 7/1984 | Buras et al. | 166/343 |
| 4,625,805 | A | * | 12/1986 | Ladecky | 166/341 |
| 4,732,215 | A | * | 3/1988 | Hopper | 166/366 |
| 4,784,527 | A | * | 11/1988 | Hunter et al. | 405/207 |
| 4,822,212 | A | * | 4/1989 | Hall et al. | 405/227 |
| 5,163,783 | A | * | 11/1992 | Fahrmeier et al. | 405/195.1 |
| 6,213,215 | B1 | * | 4/2001 | Breivik et al. | 166/350 |
| 6,805,382 | B2 | * | 10/2004 | Jennings | 285/18 |
| 8,695,627 | B2 | * | 4/2014 | Kugelev et al. | 137/363 |
| 2002/0050047 | A1 | | 5/2002 | Bekkevold et al. | |
| 2010/0147526 | A1 | * | 6/2010 | Haughom | 166/338 |
| 2012/0160509 | A1 | * | 6/2012 | Caldwell et al. | 166/363 |

FOREIGN PATENT DOCUMENTS

| | | |
|---|---|---|
| WO | WO-2008/130242 A1 | 10/2008 |
| WO | WO-2011/018120 A1 | 2/2011 |

* cited by examiner

BOP LOCK DOWN

FIELD OF THE INVENTION

The present invention in general relates to an improved well head system and in particular to an improved mechanism for locking a valve stack atop a well head, on beam members of the well template. The valve stack may be a Blow Out Preventer (BOP) and according to the invention, by virtue of this locking, the effect of bending moment on well head by the BOP and a riser connected to the BOP is substantially prevented. Particularly, the present invention relates to a well head system according to the preamble of claim 1 and to a locking device according to the preamble of claim 7.

TECHNICAL BACKGROUND OF THE INVENTION

Well head systems for sub sea exploration are traditionally known to comprise a well head having a well head housing secured to a well casing. It also comprises a valve stack, such as a Blow Out Preventer (hereinafter referred to as BOP), located atop a well head during drilling, work-over operations and some phases of the production. Especially, during drilling operations, the drill bit often penetrates pockets of pressurized formations. Due to this, the well bore experiences rapid increase in pressure and unless prevented may result in disastrous blow outs. Hence locating BOPs atop well heads is now very common and indispensable in sub sea exploration.

Now, tubular members such as risers are connected on the top of the well head housing along the through bore of a BOP. The well head housing is in turn secured to the well head casing by welding. When a riser is connected and operated on the top of the well head housing, it creates a very high bending moment on the connecting surface of the lower part of the well head housing and the upper part of the casing, i.e. at the welded joint area. As a result, the well head and casing experiences strain causing substantial fatigue and may eventually initiate cracks on the well head, thereby expediting its deterioration.

In a sub-sea drilling operation the connection of the well head housing and well head casing has to endure stress for 5000 days of the BOP and riser being connected, e.g. during work-over operation and this fairly indicates the amount of strain the well head has to withstand due to bending moment generated during riser operation with a safety factor of 10.

Now to ensure that the well head does not undergo fatigue and tear by bending moment generated during riser operation, it is essential that the BOP should be firmly locked so that less moment is transferred to the weld zone between the well head housing and the casing. This is also essential to ensure that there is no risk of blow out by virtue of a break in the weld between the well head housing and the casing.

Attempts are on over the years to appropriately secure BOPs on well heads to prevent well blow outs, but in prior art technology the approach to ensure firm locking of the BOP on the well head components, with a motive to substantially prevent the effect of bending moment on the lower part of the well head housing and the upper part of the casing during operation of tubular members such as risers, along BOP, is missing.

To be precise, the prior art does not teach locking of a BOP firmly on the well head components, such as the well template, to prevent the well head from movement due to bending moment generated during riser operation, so that fatigue of the well head is substantially reduced during riser operation.

Hence, the issue of withstanding heavy bending moment on the welded area of the housing-casing joint during riser operation and fatigue of the welded joint area still remains unresolved. This consequently, leaves the problem of minimising/nullifying fatigue of the well head and a potential risk for cracks in the joint area, unresolved. The worst eventuality of this can of course be that the well head disconnects from the casing and results in an uncontrollable blow-out.

Accordingly there was a long felt need for a locking technology for locking valve stacks, such as BOPs atop a well head on the well template, so that the effect of bending moment on the well head is substantially reduced.

The present invention meets this long felt need by locking the BOP on beam members of the well template, by providing specially configured locking devices suitably located on axially movable vertical telescopic arms, the arms being positioned along the vertical supporting columns of the BOP.

OBJECTS OF THE INVENTION

The primary object of the present invention is to provide a well head system which is capable of substantially reducing the effect of bending moment/stress experienced on its welded joint area during riser operation.

It is yet another object of the invention to provide a BOP atop a well head, which is equipped with a specially configured locking mechanism to substantially prevent the well head from movement due to bending during riser operation through the BOP.

It is a further object of the present invention to provide a locking mechanism having a plurality of locking devices for locking a BOP on beam members of the well template, so that the effect of high bending moment on the lower part of the well head housing and the upper part of casing is substantially reduced.

It is a further object of the present invention to minimise/nullify fatigue of the well head and the potential risk for cracks in the well head housing—well casing joint area, during riser operation.

It is a further object of the present invention to reduce the risk of blow out during riser operation.

It is yet a further object of the invention to provide a well head system which conforms to the regulatory criteria and safety standard in well drilling processes.

All through the specification including the claims, the words "BOP", "riser", "spindle", "columns", "frame", "beam member", "clamping arms", "winching device", "ROV", "well template" are to be interpreted in the broadest sense of the respective terms and includes all similar items in the field known by other terms, as may be clear to persons skilled in the art. Restriction/limitation, if any, referred to in the specification, is solely by way of example and understanding the present invention. Furthermore, the description and claim refers to operation of risers and it is hereby clarified that the present invention is equally applicable in respect of operation of other members operated atop sub sea well heads, as will be clear to persons skilled in the art.

SUMMARY OF THE INVENTION

According to a first aspect of the present invention there is provided a well head system for application in sub sea well exploration. It comprises a well head having a well head housing secured to a well casing and at least one valve stack, e.g. a BOP located atop the well head. According to the invention, the valve stack is removably locked on a well template supporting the well head, by a plurality of locking devices.

According to a preferred embodiment of the first aspect of the present invention each locking device comprises a spindle fixedly attached to a telescopic arm. It is adapted to axially move downward and upward with corresponding axial movement of the telescopic arms for locking and unlocking respectively.

Preferably, two opposite clamping arms are adapted to grip a beam of the well template.

More preferably, the lock comprises a securing mechanism acting to lock a main frame carrying the clamping arms to a spindle.

According to a second aspect of the present invention there is provided a locking device for securing a valve stack atop a well head having a well head housing secured to a well casing. According to the invention, the locking device is adapted to releasably lock the valve stack to a well template supporting the well head.

BRIEF DESCRIPTION OF THE DRAWINGS

Having described the main features of the invention above, a more detailed and non-limiting description of some exemplary embodiments will be given in the following with reference to the drawings, in which.

DETAILED DESCRIPTION OF THE INVENTION

The following describes a preferred embodiment of the invention which is exemplary for the sake of understanding the present invention and non-limiting.

The main aim of the present invention, as stated before, is to substantially reduce the bending moment during riser operation on the lower part of the well head housing (not shown in FIG. 1) and the upper part of the casing (not shown in FIG. 1), where the welding joint between the two is located. This is achieved primarily by firmly locking the BOP on the well template by specially configured locking devices, at several points along the supporting beams of the well template during riser operations, as hereinafter explained with reference to the drawings. This in turn facilitates reducing the effect of bending moment on the well head during riser operation, thereby increasing its longevity. By reducing the effect of such bending moment, fatigue of the well head and the potential risk for cracks in the well head housing—well casing joint area during riser operation, is substantially minimised/nullified. This in turn also reduces the possibility of most unprecedented eventuality of disconnection of the well head from the casing, resulting in an uncontrollable blow-out.

Figure 1:
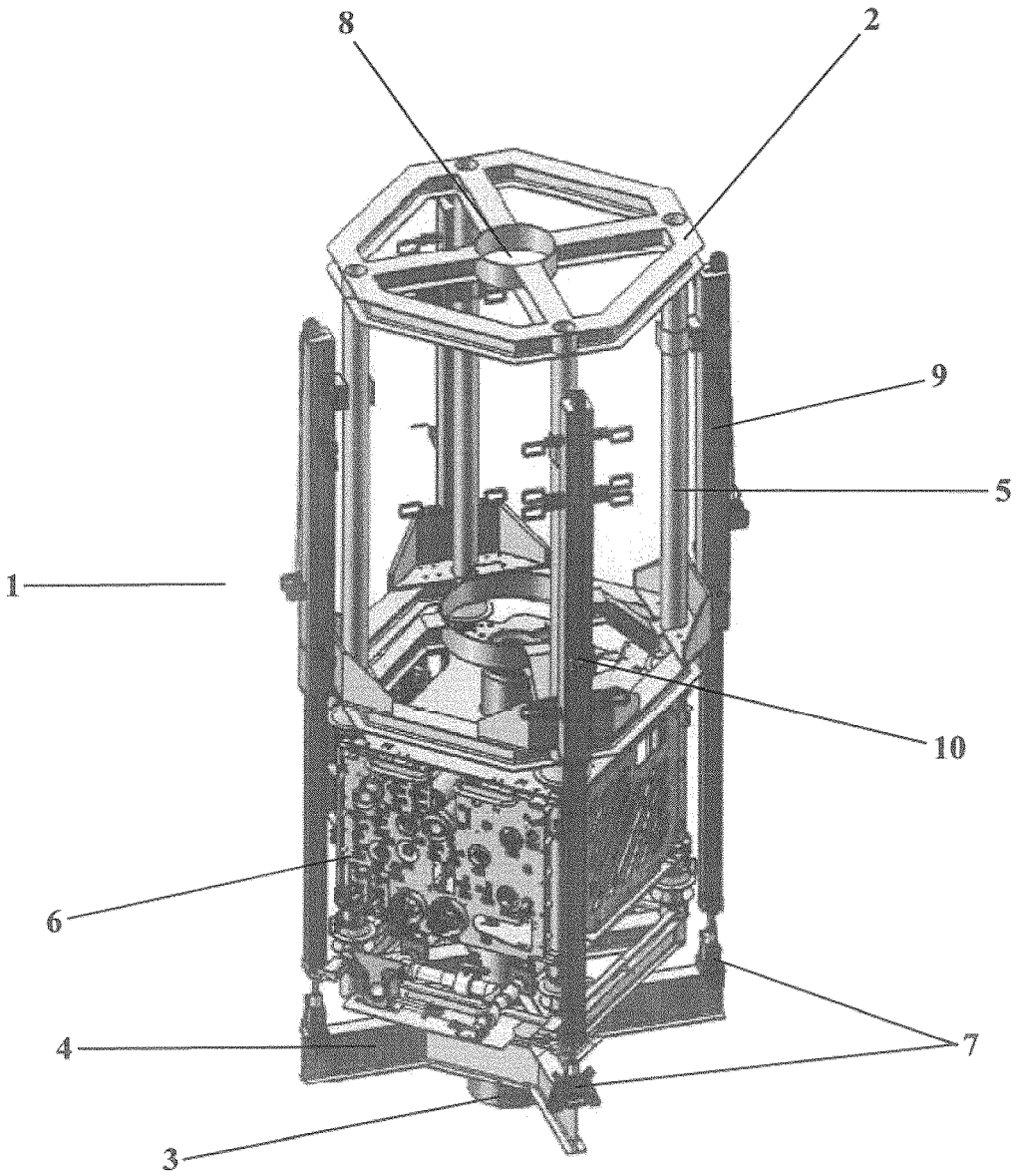
FIG. 1 is a perspective view of a BOP according to a preferred embodiment of the present invention.
Figure 5:
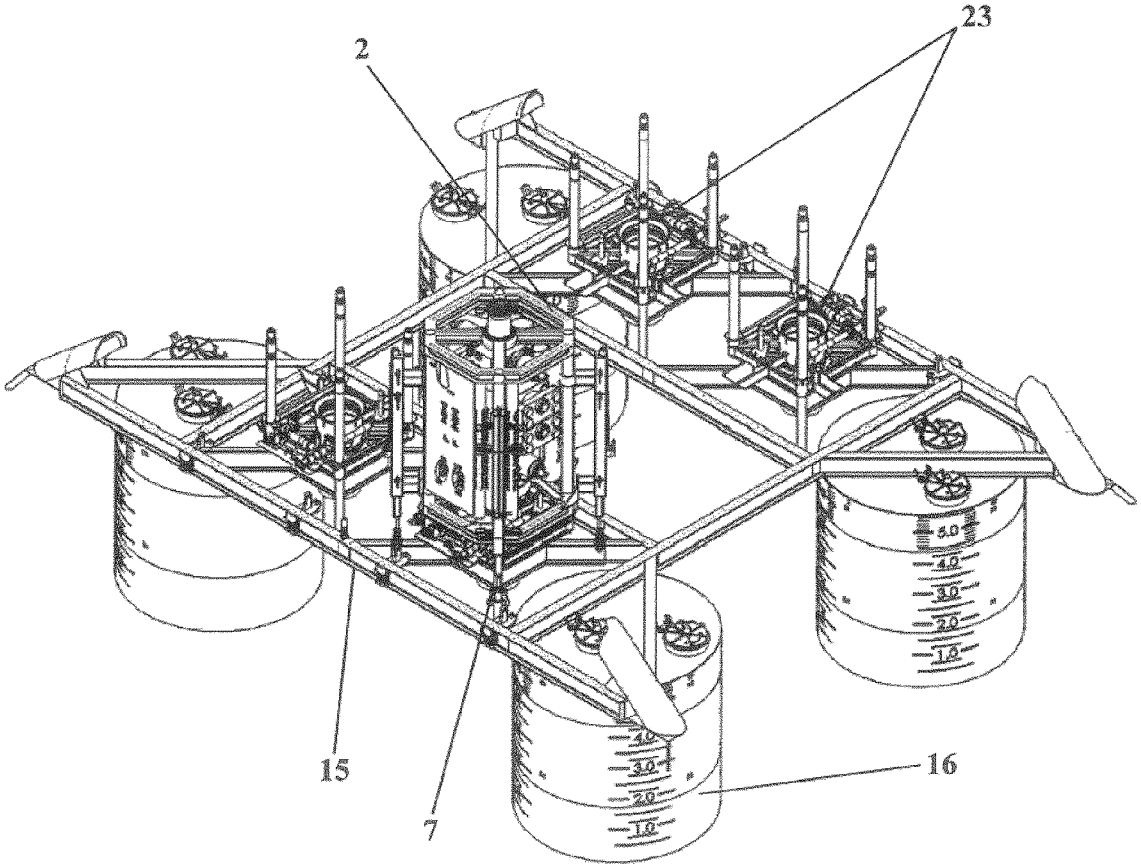
FIG. 5 is a perspective view of the BOP according to the present invention in operation showing the well head components, including a well template, the well head and the location of the locking apparatus.

FIG. 1 illustrates a BOP assembly 1 including a Christmas tree 6 and room for a BOP stack (not shown) within a BOP frame 2 which is located atop a well head 23 (best shown in FIG. 5). It comprises vertical beam members 5 along which are positioned axially movable vertical arms 9, which are preferably telescopic having one upper portion and a lower portion, the lower portion being slidable through the upper portion. This is clear from FIG. 1. The locking devices 7 are located along the slidable lower portion of the arms 9. The BOP 1 rests on the well head 23 (best shown in FIG. 5). As known to persons skilled in the art, the christmas tree 6, at the basal portion atop the well head 23 (shown in FIG. 5) may or may not be there. Tubular members such as risers (not shown) are connected to the BOP. The telescopic arms also comprise a suitably located winch device 10 for axial movement of the locking device 7. As can be seen from FIG. 1 the locking device 7 locks the BOP on horizontal beams 3, 4 of the well template (best shown as item 15 in FIG. 5). These locking devices are effective in firmly locking the BOP along several points on the well template, during riser operation, for achieving the objects of the present invention, as described hereinbefore.

Figure 2:
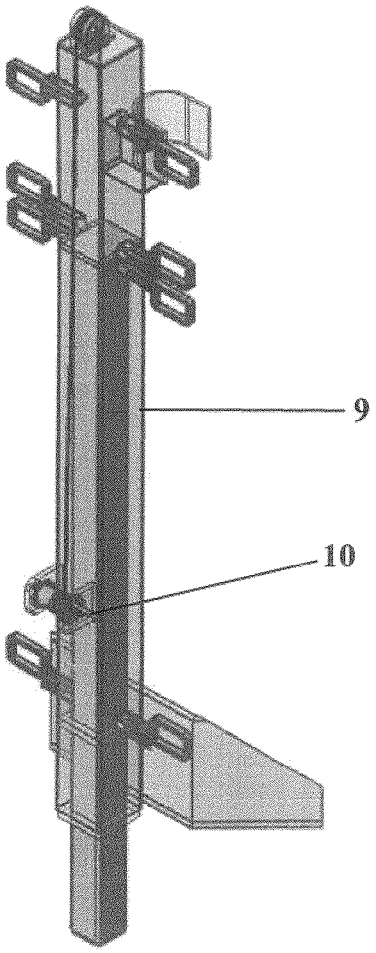
FIG. 2 is an illustrative view of the telescopic arm of the BOP having a winch device according to a preferred embodiment of the present invention.
Figure 3:
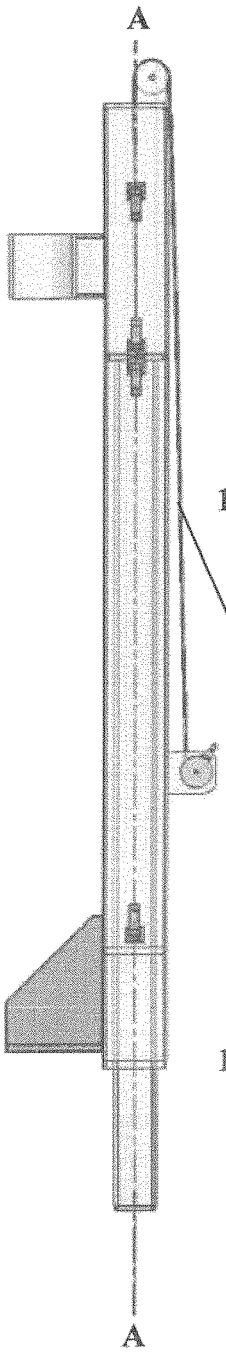
FIG. 3 is a front view of the telescopic arm shown in FIG. 2.
Figure 4:
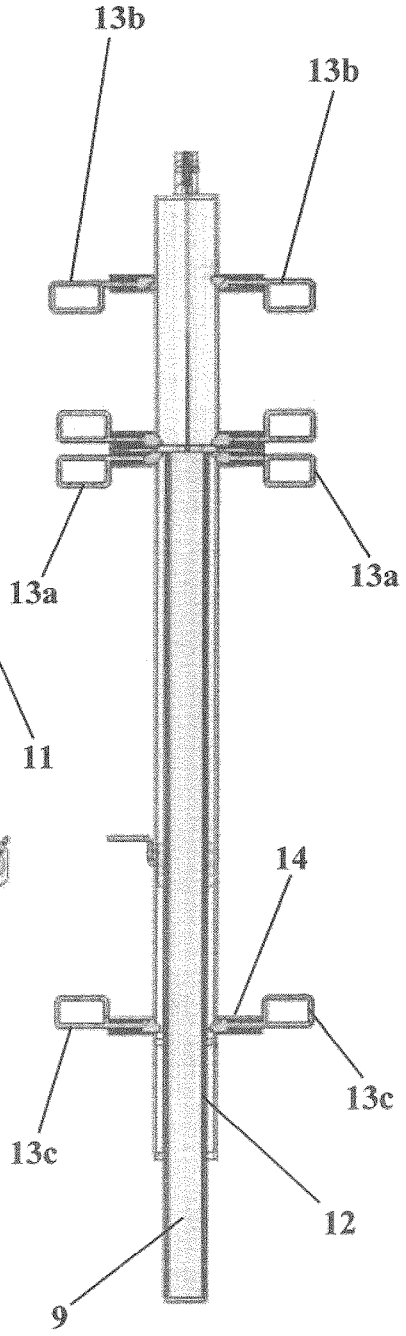
FIG. 4 is a sectional view of the telescopic arm shown in FIG. 3 along the line A-A.

The axially moving telescopic arms 9 is further illustrated in FIGS. 2, 3 and 4, showing one such arm. A winch device 10 is suitably located on the telescopic arm 9 for facilitating its axial movement in upward direction by winching action, as will be understood by persons skilled in the art. The winch has a cable arrangement 11, as shown in the accompanying FIG. 3. This arrangement facilitates withdrawal of the lower portion of the telescopic arm in upward direction, along which the locking devices are located.

FIG. 4 is a sectional view taken along the line A-A in FIG. 3 which preferably shows several handles 13*a*, 13*b* and 13*c*. Each handle is pre-tensioned by a spring 14 and acts against a stop plate 12 on the telescopic arm 9. The pair of handles 13*a* are pulled preferably by an ROV, so that the lower portion of the telescopic arm 9, having the locking devices, falls downward, thus employing the locking devices 7.

It would be clear from the accompanying FIG. 1, that the locking device 7 is located at the lower portion of the telescopic arm 9 and is lowered on the well head components by downward and axial movement of the telescopic arm 9. How this movement is caused, has been explained in the concluding portion of the preceding paragraph. This mechanism of employing the locking devices works irrespective of the distance between the well template and the initial position of the arms 9. The locking devices are also adapted to function irrespective of this distance. The handles 13*c* are preferably applied to hold up the lower portion of the telescopic arm 9, having the locking devices 7. The handles 13*b* are preferably applied, for parking the telescopic arms, when not in use.

FIG. 5 illustrates four well heads 23 and a BOP on top of one well head. It also shows a well template 15 which supports the well head and along which the locking devices 7 are connected at different points on the well template 15. As known to persons skilled in the art, the well template rests on the sea bed in deep sea drilling projects, for supporting the well head. The well template 15 is preferably supported on the supporting columns, such as suction anchors 16. The locking devices are landed on the well template in the manner as stated before which involves a simple and effective operation irrespective of the distance, but landing them correctly, is very crucial. This may be done, for example, from the deck of an offshore vessel.

Figure 6:
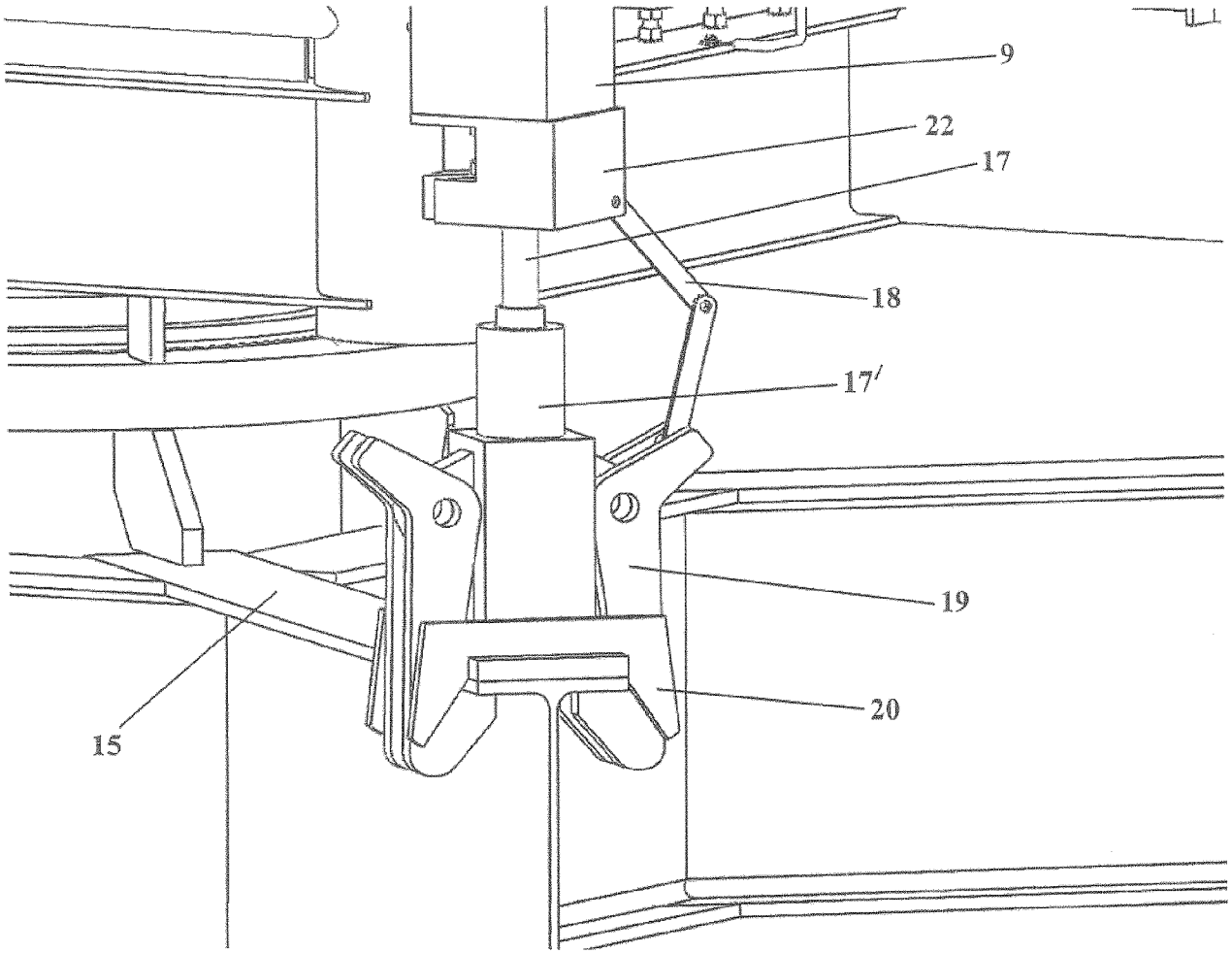
FIG. 6 is a perspective view of a preferred embodiment of the locking apparatus according to the present invention in locked position.

The locking device 7 as shown in FIG. 6 comprises a spindle 17 partially housed in a hydraulic cylinder 17', as shown in this figure. It also comprises clamping arms 19, a main frame 21, two guard members 20 running from end to end of the clamping arms 19 on either side, hinged levers 18 (only one set shown), operable with either of the clamping arms 19. The spindle 17 is fixed on a column 22 at the lower end of the telescopic arm 9, which is movable axially with the axial movement of the corresponding telescopic arm 9. As shown in FIG. 1 several locking devices 7 are located along several points, near well template 15. All such locking devices lock the BOP on the well template 15 along several points on the template 15. Consequently, there is a firm grip which disallows/substantially prevents the BOP from movement due to bending during riser operation. The FIG. 6 shows the locking device in locked position. As stated before, perfect locking is achieved by this technology, irrespective of the distance between the column 22 and the well template 15.

Figure 7:
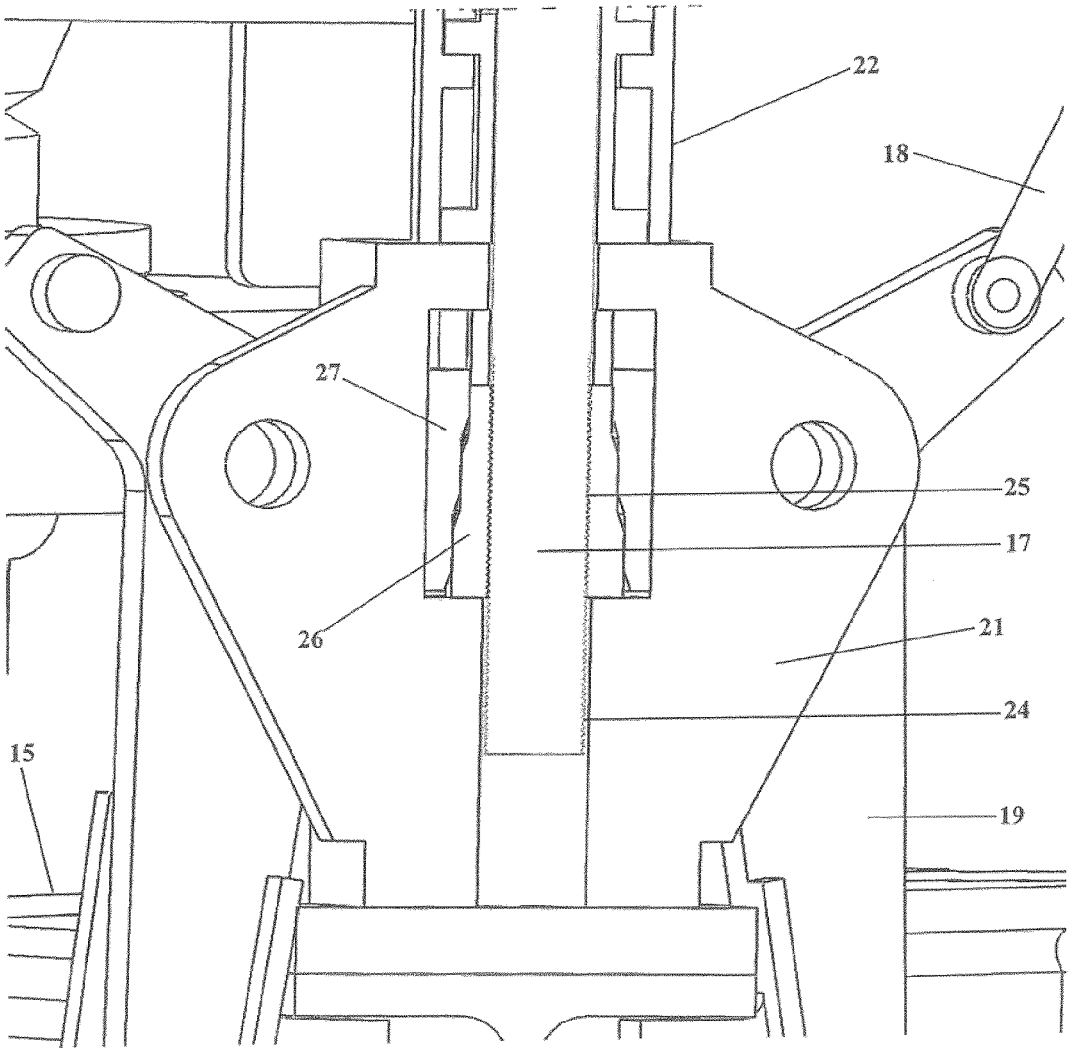
FIG. 7 is an axial cut section along the vertical axis of the device illustrated in FIG. 6 for the sake of understanding.

The FIG. 7 is an axial cut section along the vertical axis of the device illustrated in FIG. 6 for the sake of understanding. It shows some of the important features by virtue of which, the locking device grips the well template 15 after landing on the same. The spindle 17 is equipped with outer threads 24.

An inner wedge portion 26 has inner threads 25 which are adapted to mesh with the threads 24 of the spindle 17. There also exists outer wedge shaped portion 27 along the outer portion of the inner sleeve 26. How these portions contribute to effective locking, is explained hereinafter.

Now the operation of the locking device 7 is explained with reference to FIGS. 8 to 10. These figures, as can be seen show different operational positions of the locking device and these figures represent an axial cut section along the vertical axis of the device illustrated in FIG. 6 for the sake of understanding.

Figure 8:
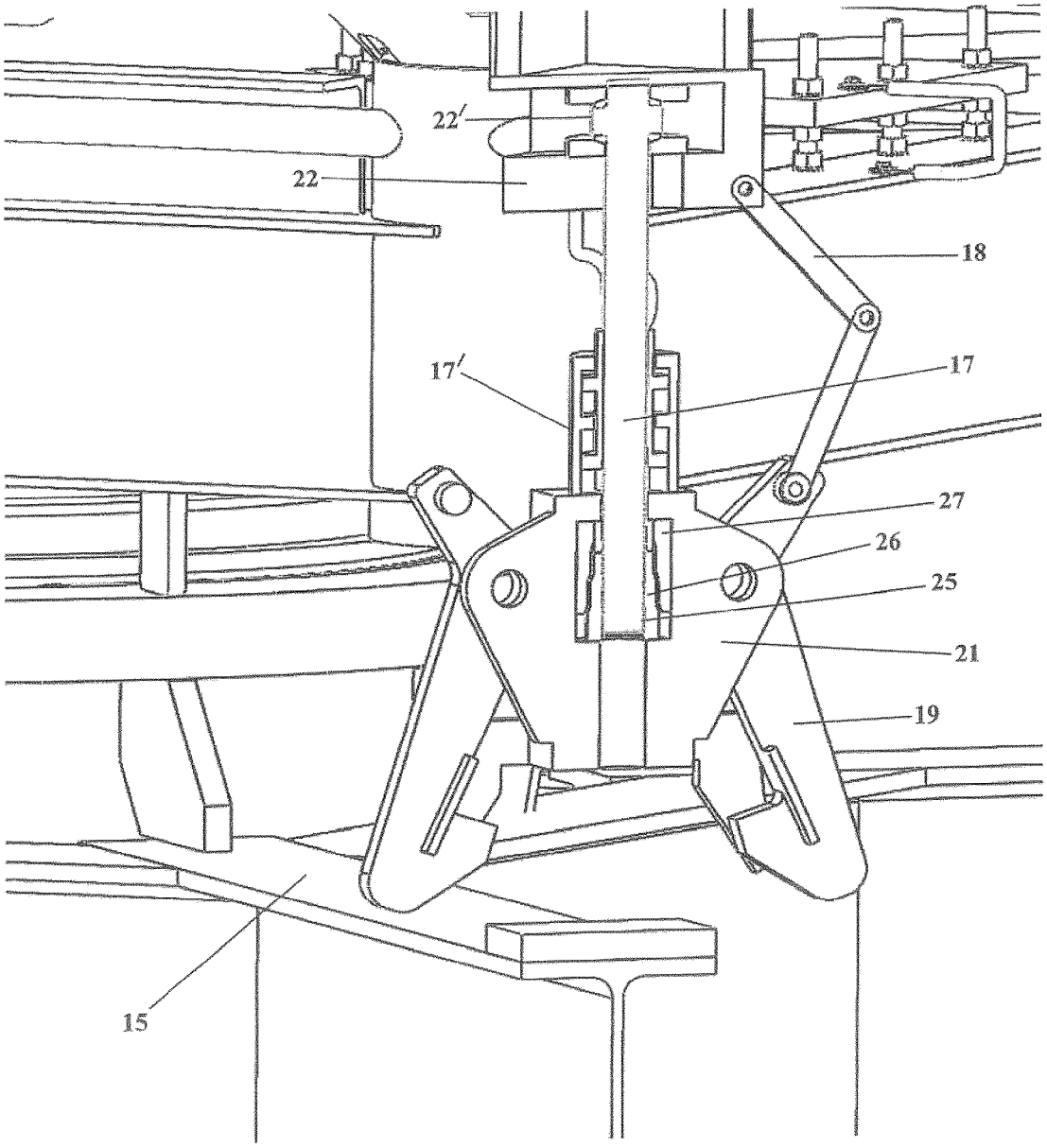
FIGS. 8 to 10 coherently illustrate the different positions of the locking apparatus during operation.

FIG. 8 shows a position when the locking device is yet to be locked on the template 15. This figure also clearly shows the different chambers in the hydraulic cylinder 17' and how the spindle 17 is attached to the column 22. Ideally, the spindle 17 is attached via a spherical ball bearing 22'. This allows the spindle to move and allow for taking up any misalignments. The other identical reference numerals represent identical features as in FIG. 7.

Figure 9:
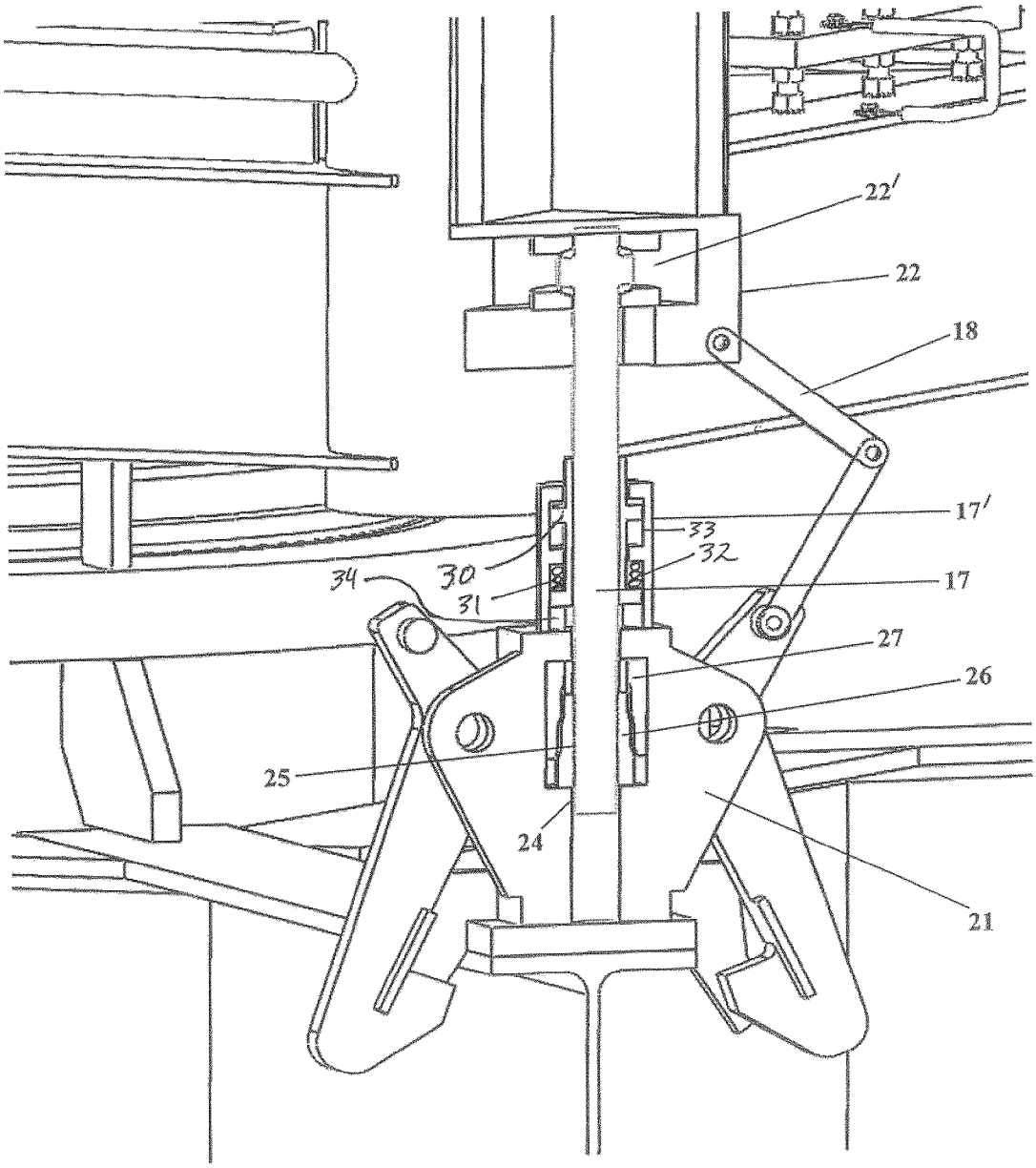

FIG. 9 shows a position where the column 22 has come down and landed the locking device 7 on the template beam 15. The abutment against the template beam presses the supporting frame 21 upwards. Thereby, the hinged levers 18 act to swing the clamping arms 19 downwards so that they come to rest against the template beams and grips around these. The hydraulic cylinder is powered by hydraulic pressure from a hydraulic fluid. As can be seen from the FIGS. 8 to 10 the cylinder has a bottom chamber 32 and an upper chamber 33. In the hydraulic cylinder 17' there is also a piston 30, which is pre-tensioned in the downward direction by a spring 31. A hydraulic pressure in the upper chamber of the hydraulic cylinder 17' acts against the spring 31, so that the piston 30 is in its uppermost position when the clamping arms are being actuated for gripping.

The hinged levers 18 actually act as leaf springs and those act to force the clamping arms 19 inwardly when the distance between the main frame 21 and the column 22 is reduced due to the main frame 21 pressing down on the beam 3, 4 and thereby being pushed upward. The leaf spring 18 may have one arm only and having at least two arms is not mandatory.

Figure 10:
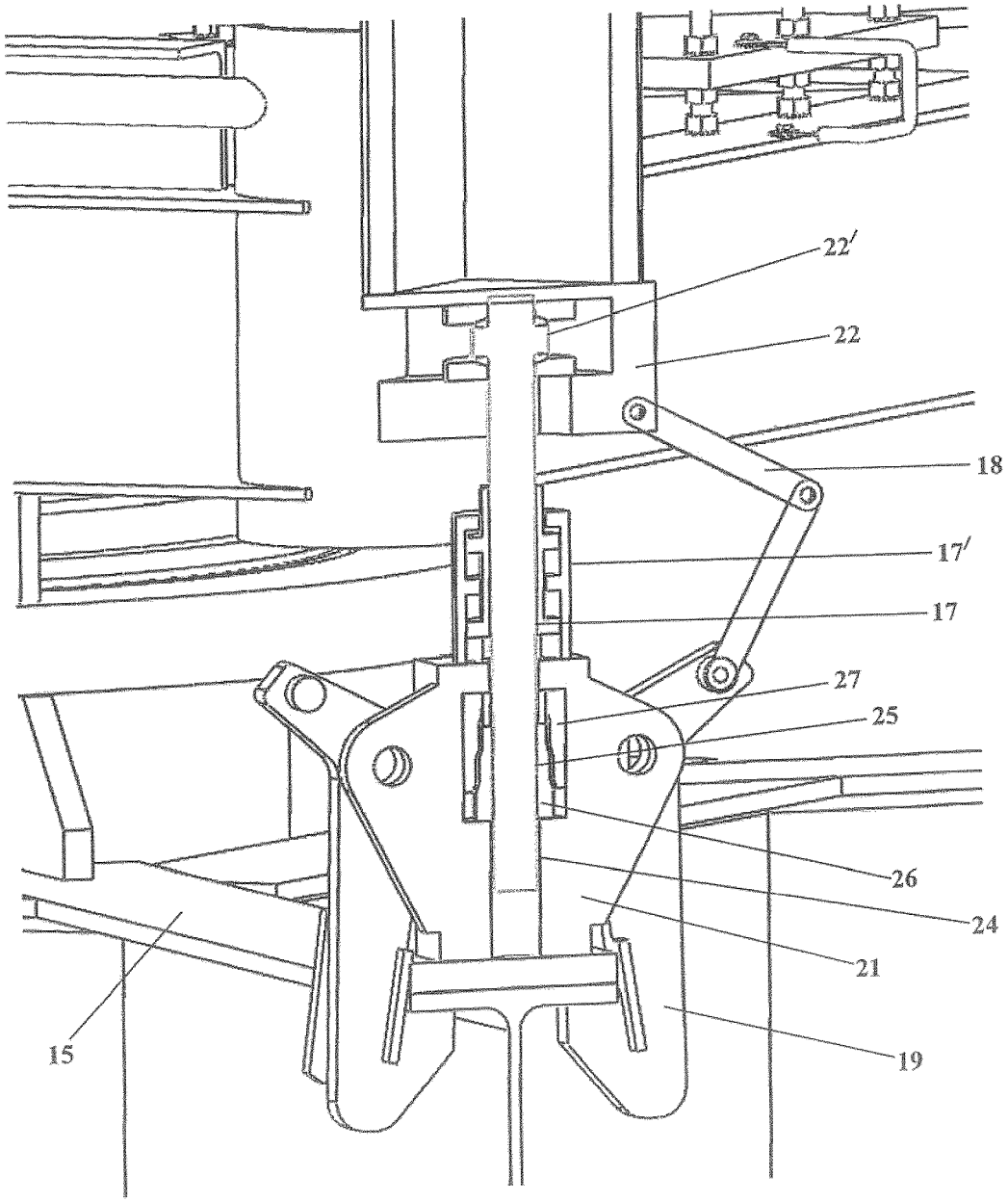

In FIG. 10 the clamping arms 19 have now closed by means of the hinged levers 18 and the grip on the template 15 is completed. As stated in the preceding paragraph, the hinged levers 18 play the role of leaf springs to force the clamping arms 19 inwardly. The guard member 20 ensures that the gripper assumes the correct position on the template beam. When the clamping arms 19 have clamped the beam 3, 4 of the template 15, the hydraulic pressure in the hydraulic cylinder 17' is released and the spring 31 actuates the lock by pushing the piston downward. The piston presses against the outer wedges 27 via pins 34 and thereby forces the outer wedges downward. The outer wedges 27 press radially against and forces the inner wedges 26 inward until their inner threads 25 mesh with the outer threads of the spindle 17. The inner and outer wedges thereby fixes the spindle 17 relative to the main frame 21, preventing the main frame 21 from moving. Thereby the spring action from the levers 18 maintains their force on the clamping arms 19 and prevents these from swinging upwards again.

Similar locking takes place along all points on the beam where respective locking devices are located and so, a firm locking of the BOP on beam 15 supporting the well head is achieved. This ensures substantial prevention of the well head from movement due to bending during riser operation with the BOP, thereby reducing the fatigue and risk of failure of the well head and increasing its lifespan.

As explained in the preceding paragraphs, the securing of the lock is largely effected by the hydraulic cylinder 17', the spring member 31, the piston 30, the inner and outer wedges 26, 27 and the spindle 17. The details of the spring member and the piston arrangement have not be illustrated in detail in the drawings, but a person of skill will have no problem understanding how this works in principle. It should be understood to persons skilled in the art, particularly with reference to the description of FIGS. 8, 9 and 10 that securing of the gripping of the well template 15 by the clamping arms 19 take place by a spindle-cam mechanism. This spindle cam mechanism involves mutual operation of the spindle 17, the spring member and the piston arrangement of the hydraulic cylinder 17', the spring leaves 18 and the clamping arms 19. All these coherently facilitate, clamping the BOP 1 firmly on the template 15 by the locking devices 7. During unlocking of the BOP, the hydraulic pressure is applied to the hydraulic cylinder 17' opposite to the spring member and the locking devices just operate in the opposite way as will be understood to persons skilled in the art.

The present invention has been described with reference to some preferred embodiments and some drawings for the sake of understanding only and it should be clear to persons skilled in the art that the present invention includes all legitimate modifications within the ambit of what has been described hereinbefore and claimed in the appended claims.

The invention claimed is:

1. A well head system for application in sub sea well exploration comprising:

a well head having a well head housing secured to a well casing;

at least one valve stack located atop said well head; and wherein said valve stack is removably locked on a well template supporting said well head by a plurality of locking devices, said locking devices comprising two opposite clamping arms that are adapted to grip a beam of the well template, said two opposite clamping arms being coupled to a main frame, said main frame in turn being slidably received on a spindle and comprising a set of wedges for securing said main frame relative to said spindle when said two opposite clamping arms are in a gripping position.

2. The well head system according to claim 1, wherein each locking device of the plurality of locking devices comprises the spindle attached to a telescopic arm.

3. The well head system according to claim 1, further comprising a lever or spring mechanism adapted to force the two opposite clamping arms into engagement with the well template.

4. The well head system according to claim 2, wherein each telescopic arm is equipped with at least one ROV operated handle that releases the telescopic arm when actuated.

5. The well head system according to claim 1, wherein a lever or spring mechanism is acting on each of the two opposite clamping arms to selectively press the two opposite clamping arms into engagement with the well template.

6. The well head system according to claim 5, wherein each locking device comprises the spindle attached to a telescopic arm and adapted to axially move downward and upward with corresponding axial movement of said telescopic arm.

7. The well head system according to claim 6, wherein the clamping arms are hingedly attached to the main frame which is slidably received on the spindle.

8. The well head system locking device according to claim 7, wherein the main frame comprises an actuator to selectably secure the main frame to the spindle.

9. The well head system according to claim 8, wherein the actuator comprises a hydraulic cylinder and a wedge mechanism.

10. The well head system according to claim 1, wherein the at least one valve stack comprises a Blow Out Preventer (BOP).

* * * * *

UNITED STATES PATENT AND TRADEMARK OFFICE

CERTIFICATE OF CORRECTION

PATENT NO. : 9,080,408 B2
APPLICATION NO. : 13/885481
DATED : July 14, 2015
INVENTOR(S) : Knut Møgedal It is certified that error appears in the above-identified patent and that said Letters Patent is hereby corrected as shown below:

Claims

Column 7, line 22, Claim 8 Replace "The well head system locking device according to claim 7," with -- The well head system according to claim 7, --

Signed and Sealed this
Twenty-fourth Day of November, 2015

Michelle K. Lee

Michelle K. Lee
*Director of the United States Patent and Trademark Office*